United States Patent [19]

Giebeler

[11] 4,176,293

[45] Nov. 27, 1979

[54] THERMIONIC CATHODE HEATER HAVING REDUCED MAGNETIC FIELD

[75] Inventor: Robert H. Giebeler, Sunnyvale, Calif.

[73] Assignee: Varian Associates, Inc., Palo Alto, Calif.

[21] Appl. No.: 879,017

[22] Filed: Feb. 17, 1978

[51] Int. Cl.[2] ..... H01J 1/15; H01J 19/08; H01K 1/02

[52] U.S. Cl. ..... 313/343; 313/337; 313/341

[58] Field of Search ..... 313/341, 342, 344, 337, 313/343

[56] References Cited

U.S. PATENT DOCUMENTS

| | | | |
|---|---|---|---|
| 2,899,591 | 8/1959 | Stein | 313/337 |
| 3,134,691 | 5/1964 | Kopecky | 313/334 |
| 3,226,806 | 1/1966 | Gatewood | 313/341 X |
| 3,255,375 | 6/1966 | Ward | 313/344 X |
| 3,259,784 | 7/1966 | Vogel | 313/344 X |

*Primary Examiner*—Saxfield Chatmon, Jr.
*Attorney, Agent, or Firm*—Stanley Z. Cole; Robert K. Stoddard; Peter J. Sgarbossa

[57] ABSTRACT

An electrically resistive heater consisting of a helix of resistive wire, the helix being shaped into a toroid or a spiral, with the electrical return lead extending coaxially through the helix so as to provide a magnetic field of equal magnitude and opposite sense to that produced by current in the helix to cancel the magnetic fields.

11 Claims, 4 Drawing Figures

THERMIONIC CATHODE HEATER HAVING REDUCED MAGNETIC FIELD

BACKGROUND OF THE INVENTION

Electrical resistance heaters for indirectly heated thermionic cathodes in general produce stray magnetic fields which can adversely affect the operation of the cathode and in turn the operation of an electron tube into which the cathode is incorporated.

If the heater is to be operated from a source of AC voltage, the resulting AC magnetic field in the regions surrounding the heater will cause modulation of the electron flow in the region near the cathode. The result can be spurious signals, poor focusing of the electrons into a beam in beam-type tubes, and possible increases in beam interception on unwanted parts of the tube.

In the case of DC operation of the heater, the stray magnetic field distorts the path of the electrons in the regions where it is present, requiring that it be taken into account in designing electron beam optics. Moreover, since DC power supplies can be expected to show fluctuations in output voltage with changing load conditions on the power mains, etc., even a DC operated heater can be expected to produce some AC magnetic field components.

In order to combat these effects of stray magnetic field resulting from heater current, the prior art has resorted to the use of bifilar heater constructions in which the heater was wound of double conductor wire with one of the conductors being used as a current supply lead and the other a current return path. Thus, at each point on the heater winding the equal currents would be balanced, each one cancelling the stray magnetic field produced by the other.

Although this bifilar construction has proven excellent as far as the cancellation of stray magnetic fields, it has brought with it several disadvantages of its own. Specifically, the placement of the current supply and return conductors very close together for good magnetic field cancellation has sometimes resulted in accidental touching of the two conductors producing a destructive short circuit. Since it is common practice in many types of electron tubes to imbed the heater in a suitable sintered refractory potting compound, such short circuits have occurred all too often as the result of the pressures exerted on the heater during the process of forming a "compact" of refractory powder around the heater prior to sintering.

Additional failures of such bifilar heaters have occurred when they are operated from DC power supplies. These failures resulted from the development of electrically conductive paths through the refractory insulation material, produced by electrolysis of the refractory material or one of its impurities under the influence of high temperatures and the (uni-directional) electric field between the closely spaced bifilar conductors.

In many cases these problems associated with bifilar construction have resulted in its discontinuance, stray magnetic fields being then suppressed by either spacing the heater farther away from the cathode, or providing a layer of high temperature magnetic material such as cobalt between the heater and cathode to shield the latter from the stray magnetic field.

While the constructions utilizing a heater spaced far enough away from a cathode to avoid the influence of stray magnetic fields have been more or less satisfactory, they are not as efficient in terms of heater size and power consumption as when the heater can be located in close proximity to the cathode.

The provision of magnetic shielding material between heater and cathode is critically limited by the fact that no satisfactory material exists for operation in the range above 1000 degrees C., the Curie temperature of cobalt. Since dispenser type cathodes are usually operated above 1000 degrees C., cobalt is not a satisfactory magnetic shielding material.

SUMMARY OF THE INVENTION

According to the present invention stray magnetic field resulting from heater current can be very nearly eliminated by magnetic field cancellation as in the bifilar heaters, without encountering the limitations and disadvantages of the bifilar construction.

Accordingly, it is the principal object of the present invention to provide a heater for indirectly heated thermionic cathodes which produces negligible stray magnetic field in the region of the cathode.

It is a further object of the present invention to provide a heater which is so constructed to be durable and to withstand the forces attendant upon mounting the heater in a compressed insulative medium adjacent the cathode.

It is a further object of the present invention to provide a heater in which sufficient space is maintained between the conductors thereof to inhibit the formation of electrical leakage paths by electrolysis of the surrounding insulative medium.

These and other objects of this invention are accomplished by the provision of a heater in which a first conductor is provided in a hollow form, a second conductor of the heater extending through the hollow first conductor in insulative relationship therewith, the two conductors being electrically interconnected at only one of their common ends, their other ends being used as heater current leads for connection to a heater power supply.

This invention as well as other objects, features, and advantages thereof will become apparent upon reading the following detailed description of a preferred embodiment of the invention and considering the accompanying drawings in which:

DETAILED DESCRIPTION OF THE PREFERRED EMBODIMENT

Figure 1:
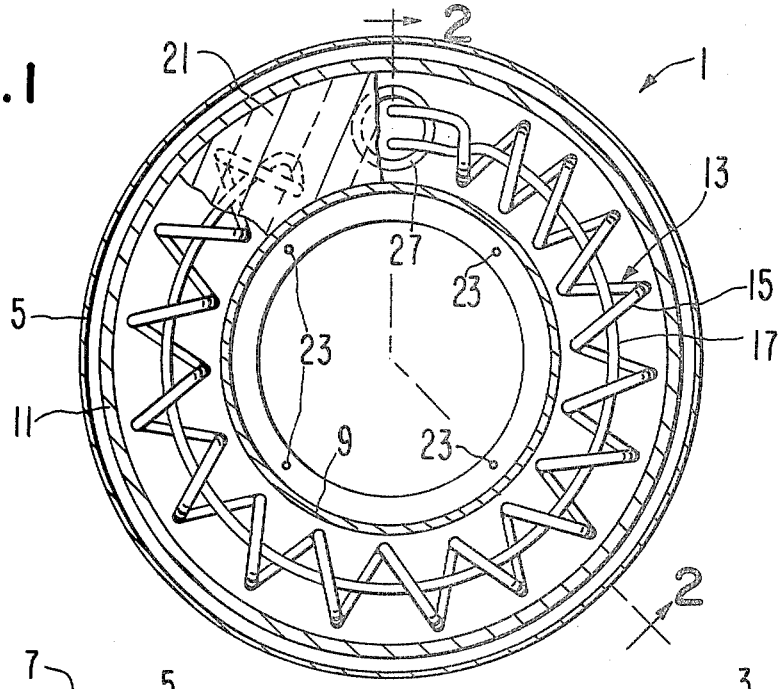
FIG. 1 is a cross-section of an indirectly heated cathode incorporating a heater according to the present invention.
Figure 2:
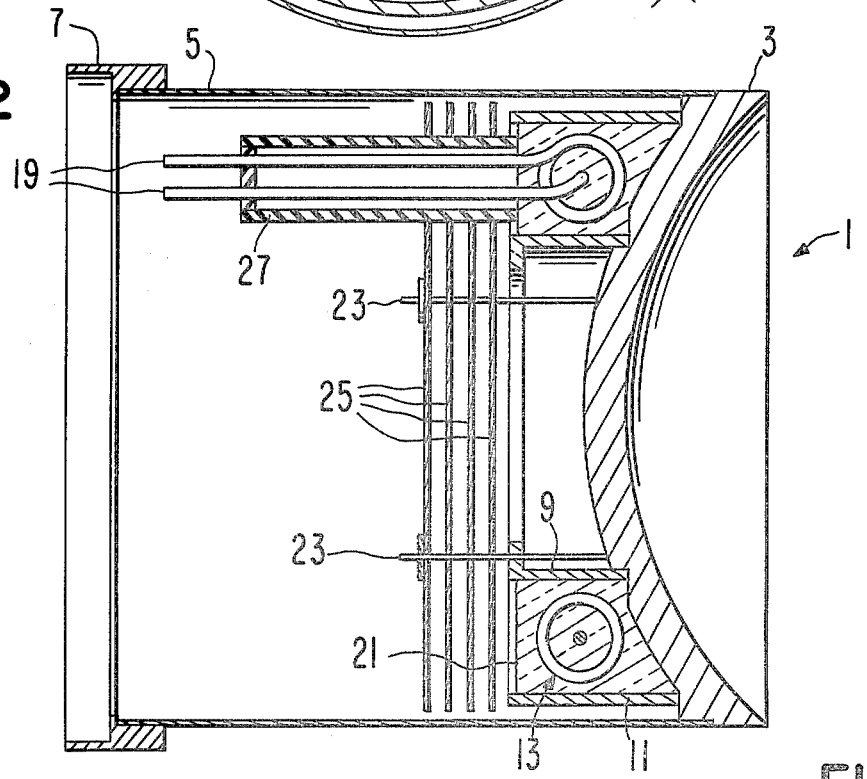
FIG. 2 is a longitudinal cross-section of the cathode of FIG. 1 taken along the lines 2—2 in FIG. 1.

FIGS. 1 and 2 illustrate a thermionic electron emitter in the form of an indirectly heated cathode 1 including a cathode electrode 3 which may be of any known type such as the oxide-coated nickel cathode or a tungsten matrix dispenser-type cathode.

Peripherally joined to the rear surface of cathode electrode 3 is a cylindrical heat shield 5 which may be made of a high temperature refractory metal such as molybdenum, joined to cathode electrode 3 by a high temperature brazing material. A flange ring 7 is similarly joined at the other end of heat shield 5 for mounting the assembly in an electron tube, for example.

Concentrically joined to the rear surface of cathode electrode 3 by a high temperature brazing material are a pair of inner 9, and outer 11 retainer sleeves. Within the cylindrical recess formed between inner and outer retaining sleeves 9 and 11 is disposed an electrical resistance heater 13 having an outer conductor 15, which is generally in the shape of a hollow toroid, and an inner conductor 17 which extends generally coaxially through outer conductor 15.

As can best be seen in FIG. 1 conductors 15 and 17 are interconnected at one of their common ends and extend from the other of their common ends to form heater leads 19 for connection to an external source of AC or DC heater power (not shown).

Heater 13 is mounted in close proximity to cathode electrode 3 by a sintered refractory potting compound 21 which may comprise, for example, alumina ($Al_2O_3$) disposed in powdered form around heater 13 and then compressed and sintered into a relatively dense refractory insulator.

Supported upon four equally spaced alignment pins 23 are four flat, circular heat shields 25. Pins 23 and shields 25 may be made of a refractory metal. Heater lead insulator 27 which may be made of a refractory insulator material such as alumina extends through an aperture in shields 25 and encloses and insulates heater leads 19.

In operation with heater leads 19 connected to a source of AC or DC power, heater current flows serially through outer conductor 15 and inner conductor 17 producing heat by the resistance effect ($i^2r$) and heating cathode electrode 3 to a temperature in the neighborhood of 1000 degrees C. at which point electrode 3 emits thermionic electrons. For example, in a cathode 1 requiring approximately 100 watts of heater power, the heater supply might be 10 volts at 10 amperes.

Outer conductor 15 which in the embodiment of FIGS. 1 and 2 is shaped generally as a hollow toroid may conveniently be formed by helically winding resistance wire and forming the helix into the shape of a toroid. Inner conductor 17 may be formed of the same piece of resistance wire and extends throughout the length of this toroid, being held in an approximately coaxial position therewith by the potting compound 21 which completely fills the region around and within outer conductor 15. As has already been noted inner and outer conductors 15 and 17 are interconnected at one of their common ends, while their other common end serves as a point of connection to the source of heater power. As a result these conductors are connected in series circuit relationship such that all heater current flows serially through both conductors. However, the direction of current is opposite in the two conductors.

Outer conductor 15 consists of a number of turns of wire and would, if it were shaped as a straight solenoidal winding, produce a considerable magnetic field of dipole form as is well known. However, by forming outer conductor as a nearly closed toroid (i.e., bringing the ends of the helix close together), this dipole field can be very considerably reduced to near insignificance.

However, there is an additional magnetic field component from outer conductor 15 produced by the component of current in a direction around the toroid from one end of outer conductor 15 to the other. This "single turn" magnetic field is not compensated by bringing the ends of outer conductor 15 close together.

According to the present invention this "single turn" magnetic field is cancelled by the fact that inner conductor 17 extending coterminously through outer conductor 15 carries the same heater current in the reverse direction compared to the direction of current in outer conductor 15. Moreover, this cancellation of magnetic field takes place without the fragility and vulnerability inherent in bifilar constructions because of the close spacing of the conductors in that construction. Neither is the heater construction according to the present invention as susceptible to electrolysis breakdown of the surrounding insulative medium (potting compound 21) under DC excitation because of the greater spacing between inner and outer conductors 15 and 17.

Figure 3:
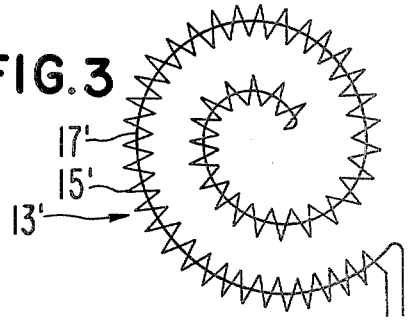
FIG. 3 is a plan view showing an alternative embodiment of the heater according to the present invention.

FIG. 3 shows an alternative embodiment of a heater 13' according to the present invention in which the hollow outer conductor 15' has been formed into the shape of a spiral. This type of construction is especially adapted to uniformly heating relatively large-area cathodes. The spiral may be flat, but it can also be dish-shaped to better conform to the shape of a cathode electrode.

Figure 4:
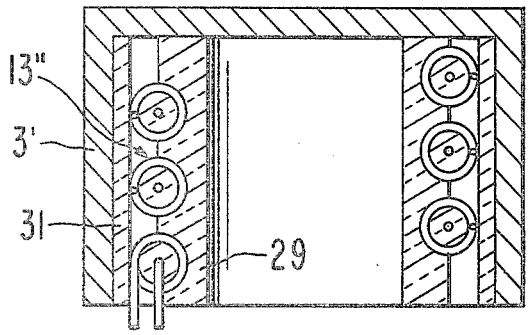
FIG. 4 is a longitudinal cross-section of an alternative heater and cathode according to the present invention.

FIG. 4 shows another alternative embodiment in which a heater 13'' has been formed into a short helix having three turns. Heater 13'' is captured and supported between inner refractory insulative cylinder 29 and outer refractory insulative sleeve 31, through which heat is transmitted to cathode electrode 3'.

In FIG. 4, heat is transmitted from heater 13'' to sleeve 31 and cathode electrode 3'' partly by radiation through the space between cylinder 29 and sleeve 31, and partly by conduction through the refractory ceramic of which these elements are made. The invention is equally applicable to heaters which transmit heat through radiation, or conduction and also to heaters which themselves serve as thermionic cathodes (so-called directly heated cathodes).

Similarly, although the inner conductor of the heater has been shown and described as being insulated from and coaxially supported within the outer conductor by filling the volume therebetween with an insulative refractory potting compound, it should be understood that when appropriate the invention may be practiced by utilizing a series of beads (not shown) of a refactory ceramic such as alumina positioned along the inner conductor at spaced intervals.

Therefore, since many changes could be made in the above construction and many apparently different embodiments of this invention could be made without departing from the scope thereof, it is intended that all matter contained in the above-description or shown in the accompanying drawings shall be interpreted as illustrative and not in a limiting sense.

What is claimed is:

1. In a thermionic electron emitter, an electrical resistance heater comprising at least nearly one turn of a first curved hollow helical conductor, and a second conductor extending through said first conductor in spaced electrically insulative relationship therewith, said first and second conductors being electrically interconnected at one common end thereof, the other ends of said conductors being electrically discrete, whereby a source of electric power connected between said discrete ends will cause current to flow serially through said first and second conductors, the direction of current in the two conductors being in the opposite sense and stray magnetic field due to the movement of said current are minimized.

2. In the thermionic electron emitter of claim 1, said first hollow conductor comprising a helix formed of resistive wire, said second conductor being a resistive wire extending through the space enclosed by said helix.

3. In the thermionic electron emitter of claim 1, said first conductor being torsidal in shape.

4. In the thermionic electron emitter of claim 1, said first conductor being shaped into a spiral.

5. In the thermionic emitter of claim 1, said first conductor being shaped into a helix.

6. In the thermionic electron emitter of claim 1, said common end of said conductors being positioned adjacent said discrete ends of said conductors.

7. In the thermionic electron emitter of claim 6, said common end of said conductors facing said discrete ends.

8. In the thermionic electron emitter of claim 1, said nearly one turn of said first curved hollow conductor being torodial in shape.

9. In a thermionic electron emitter, an electrical resistance heater comprising a first curved hollow helical conductor, and a second conductor extending through said first conductor in spaced electrically insulative relationship therewith, said first and second conductors being electrically interconnected at one common end thereof, the other ends of said conductors being electrically discrete, said common end and said discrete ends being positioned adjacent each other whereby a source of electric power connected between said discrete ends will cause current to flow serially through said first and second conductors, the direction of current in the two conductors being in the opposite sense, and stray magnetic fields due to the movement of said current are minimized.

10. In the thermionic electron emitter of claim 9, said common end being in opposed relationship with said discrete ends.

11. In the thermionic electron emitter of claim 10, said first conductor being torodial in shape.

* * * * *